United States Patent [19]

Gold

[11] 4,316,740

[45] Feb. 23, 1982

[54] COAL REACTOR CONSERVATION OF BLAST FURNACE COKE

[76] Inventor: Louis Gold, 2745 29th St., NW., Washington, D.C. 20008

[21] Appl. No.: 44,554

[22] Filed: Jun. 6, 1979

[51] Int. Cl.[3] ..... C21B 5/00
[52] U.S. Cl. ..... 75/42
[58] Field of Search ..... 75/42, 41

[56] References Cited

U.S. PATENT DOCUMENTS

| | | | |
|---|---|---|---|
| 3,954,444 | 5/1976 | Wenzel et al. | 75/42 |
| 4,080,196 | 3/1978 | Gold | 75/42 |
| 4,159,201 | 6/1979 | Staege | 75/42 |

*Primary Examiner*—M. J. Andrews

[57] ABSTRACT

Coke consumption may be cut as much as fifty percent using a coal reactor to furnish carbon monoxide for ore reduction in a blast furnace while lowering the sulfur content of pig iron accompanied by a smaller slag volume.

1 Claim, No Drawings

COAL REACTOR CONSERVATION OF BLAST FURNACE COKE

BACKGROUND OF THE INVENTION

With high grade coke becoming scarcer and much more expensive, the need for its conservation continues to grow. Various methods have been tried to diminish coke consumption without much success. The Coal Reactor in its ability to generate clean carbon monoxide quite economically, even from poor quality fossil fuels, provides the basis for achieving this goal. An elementary theory allows an estimate of the coke saving possible under reasonable operating conditions with resulting diminished impurities in pig iron. A more illuminating theory based upon complete chemical reactions that are energetically self-sustaining yields the same simple formula in the limit where no direct ore reduction occurs.

The relationship deduced from the cost effectiveness of having steam coal burned in the Coal Reactor to generate CO and using correspondingly less coke in the blast furnace is:

$$D=(2Wd_1+Vd_2)/(2W+V)$$

Where V and W are the relative amounts of CO and $O_2$ and $d_2$ and $d_1$ denote the cost for steam coal and coke, respectively. In the limit of $V \rightarrow 0$, the cost for the coke alone enters; quite clearly at some critical value of the $CO/O_2$ ratio, fed via the tuyeres into the combustion zone, an inadequate heat balance occurs beyond which no further coke saving is possible.

Thus, to be sure that a realistic case is employed in estimating V, the composition 79% (by volume) CO and 21% $O_2$ is chosen, corresponding to the satisfactory heat balance for the conventional air blown blast furnace; in the example considered, oxygen rather than air is mixed with CO in the combustion process. For $d_1$=\$100/ton and $d_2$=\$30/ton, the value of D becomes 55/ton, reflecting an effective addition to the blast furnace of a mix of approximately 35% coke and 65% steam coal. However, by the device of burning cheaper coal in a separate reaction vessel, the Coal Reactor, a greater dilution of the coke is obtainable than is what is possible otherwise, since the direct addition of coal to the blast furnace is limited to about 15%. Beyond this range, the mechanical strength for the charge column is too greatly diminished, related to a significant reason why coke must be used instead of coal in the first place.

Generating a portion of the CO outside the blast furnace further means cleaner operation with proportionately less sulfur and other impurities in the pig iron itself, a circumstance favorable for production of higher quality steel. A much more sophisticated theory of the blast furnace underlies the present innovation. An entirely new discipline of econochemistry has been discovered of which econometallurgy is but a part. The competition between direct and indirect ore reduction, together with the slag chemistry out of which the energetics and diagnostics derive can thus be taken into account.

All this relates to the correct manner of evaluating the materials/energy balance for the blast furnace which today still rests on the chemical engineering and process embodiment of uncoupled reactions deriving from the Lavoisier concept of independent balanced chemical equation. The present invention cannot be properly understood in the old light, and perhaps explains why blast furnace technology has languished.

SUMMARY OF THE INVENTION

Bringing the Coal Reactor and the blast furnace together in the symbiotic fashion indicated, demonstrates the great significance in the new science of coupled chemical reactions in self-sustaining systems. The present invention illustrates how such variance of vertical shaft furnaces can cooperatively be operated to derive benefits not otherwise attainable. In the absence of ore reduction, the Coal Reactor can perform more effectively in the production of energy, partly as heat and the remainder as a clean gas; requiring a slagging action different from what must be required for the blast furnace itself.

In other words, the blessings of the Coal Reactor invention, (U.S. Pat. No. 4,004,895 which discloses a method for the clean combustion of sulfur bearing coal in the presence of limestone in a substantially closed system consisting essentially of said coal and said limestone to provide a slagging action for removal of ash and sulfur bearing compounds resulting from said burning and having a reducing atmosphere thereby preventing the formation of sulfurous oxides and producing a fuel gas. The gas is comprised substantially of approximately 60–65% nitrogen and 30–35% carbon monoxide with trace amount of carbon dioxide, hydrogen and water vapor.) can contribute to modernization of the iron and steel industries, offering a substantial benefit in improving the efficiency and overall technology of blast furnace practice.

DETAILED DESCRIPTION OF THE INVENTION

The size of a Coal Reactor must match that of a blast furnace, which means that the former needs to consume thousands of tons daily with the prospect of huge power production as even larger blast furnaces emerge pursuant mounting efficiency of pig iron production associated with diminishing surface to volume ratio. In fact, the Coal Reactor unencumbered by ore reduction can have an even more favorable surface to volume ratio stemming from a shallower bed in a squat appearing furnace.

Excess fuel gas left over, after the CO supply to the blast furnace is properly adjusted, can be combined with the resulting enriched blast furnace gas, to not only operate the facility, but also furnish power as an auxiliary utility station. Where the local demands for energy justify a large excess of coal reactor gas, the combined operation of power production and steel manufacture could mean significant economic gains.

It should be noted that some hydrogen will accompany CO from the release of moisture and pyrolytic decomposition products in the Coal Reactor. When the actual composition of the gaseous products fed into the blast furnace is known, the appropriate correction can be made in the detailed econometallurgical analysis incorporating the modified coupled chemical equation. In ensuring the production of clean gas, a feed back mode of operating the Coal Reactor can be employed (U.S. Pat. No. 4,080,196) to redirect the gas stream from the cooler portions of the furnace on a return path through the calcination zone where the slagging action occurs. Thus, a much hotter gaseous effluent from the coal reactor results to make it even less likely that the conventional blast furnace stoves normally used to preheat the air blast, will be necessary to maintain an adequate head balance supportive of steady state operation.

What also is apparent is the absence of nitrogen throughout with air replaced by oxygen. By careful attention to the heat balance, there is no need to overheat the refractory walls in the vicinity of the tuyeres where the highest temperatures arise within the combustion zone. Since the blast furnace in the present arrangement will tend to be freer of impurities, particularly the abrasive ash components, the lining ought to experience enhanced durability. Furthermore, with fluxing action shared by the Coal Reactor, less lime stone with subsequent smaller slag volume accompanies the dualistic vertical shaft furnace operation of the blast furnace itself.

A particularly exciting feature is the production of a greater slag volume from the Coal Reactor having a composition better suited for encapsulation of toxic wastes, only recently described in other innovative patent applications (Ser. Nos. 30,991 and 30,992).

What is claimed is:

1. A method of conserving substantial amounts of coke consumed in blast furnace practice by the injection of carbon monoxide from a coal reactor using cheaper grades of coal while lowering the sulfur content of the pig iron comprising the following steps:

(a) burning a sulfur bearing coal in a coal reactor in the presence of limestone in a substantially closed system consisting essentially of said coal and said limestone and having a reducing atmosphere, thereby preventing the formation of sulfurous oxides and producing a hot fuel gas comprised substantially of nitrogen and carbon monoxide and a slag for removal of sulfur bearing compounds resulting from said burning (b) injecting said hot fuel gas into a blast furnace wherein air is replaced by oxygen, said overall operation yielding a lower sulfur content pig iron as well as conserving coke.

* * * * *